US007625361B2

(12) United States Patent
Suzuki et al.

(10) Patent No.: US 7,625,361 B2
(45) Date of Patent: Dec. 1, 2009

(54) CATHETER KIT FOR BURROW

(75) Inventors: Yutaka Suzuki, Atagoforesttower 301, 3-1, Atago 2-chome, Minato-ku, Tokyo (JP) 105-0002; Yukihiko Sakaguchi, Akita (JP); Kiyotaka Arikawa, Akita (JP); Yasunori Kojo, Akita (JP)

(73) Assignees: Sumitomo Bakelite Company Limited, Tokyo (JP); Yutaka Suzuki, Tokyo (JP)

( * ) Notice: Subject to any disclaimer, the term of this patent is extended or adjusted under 35 U.S.C. 154(b) by 0 days.

(21) Appl. No.: 10/554,499

(22) PCT Filed: Apr. 26, 2004

(86) PCT No.: PCT/JP2004/005976

§ 371 (c)(1),
(2), (4) Date: Sep. 7, 2006

(87) PCT Pub. No.: WO2004/096115

PCT Pub. Date: Nov. 11, 2004

(65) Prior Publication Data

US 2007/0016134 A1 Jan. 18, 2007

(30) Foreign Application Priority Data

Apr. 28, 2003 (JP) ..... 2003-123599
Aug. 29, 2003 (JP) ..... 2003-305683

(51) Int. Cl.
*A61M 29/00* (2006.01)

(52) U.S. Cl. ..... 604/264; 604/910; 604/104; 604/167.01; 604/167.02; 604/167.03; 604/164.01; 604/164.07; 604/164.12; 604/166.01; 604/170.02; 604/178; 604/506

(58) Field of Classification Search ..... 604/264, 604/167.01, 167.03, 164.04, 164.01, 160, 604/164.03, 164.07, 164.12, 164.13, 166.01, 604/170.01–170.02, 178, 181, 506; 606/167, 606/185
See application file for complete search history.

(56) References Cited

U.S. PATENT DOCUMENTS 2,556,783 A * 6/1951 Wallace ..... 606/127

(Continued)

FOREIGN PATENT DOCUMENTS

FR 2790950 9/2000

(Continued)

*Primary Examiner*—Nicholas D Lucchesi
*Assistant Examiner*—Quynh-Nhu H Vu
(74) *Attorney, Agent, or Firm*—Oblon, Spivak, McClelland, Maier & Neustadt, L.L.P.

(57) ABSTRACT

A catheter kit for a burrow having a catheter and an obturator and excellent in operability. The catheter comprises a tube having, inside, a nutrient passage leading nutrition or chemicals from the outside of a body to the inside of a stomach and extending along the wall surface of the burrow and a non-balloon type endodwelling member fitted to the tip part of the tube, normally placed in an expanded state and reduced in diameter less than that in the expanded state when an external force acts thereon by the obturator, and indwelled in the stomach in a buried state in a living body. The obturator comprises a guide wire passage detachably engaged with the catheter and allowing a guide wire installed in the obturator ranging from the tip to the midway thereof to be inserted therein and an operation part for transmitting the external force to the endodwelling member fitted to the rear end thereof. The rear end part of the guide wire passage and the operation part are arranged in a separated state.

14 Claims, 13 Drawing Sheets

U.S. PATENT DOCUMENTS

| | | | | | |
|---|---|---|---|---|---|
| 3,175,554 | A | * | 3/1965 | Stewart | 600/567 |
| 3,788,318 | A | * | 1/1974 | Kim et al. | 604/164.03 |
| 3,915,171 | A | * | 10/1975 | Shermeta | 604/101.5 |
| 4,315,513 | A | | 2/1982 | Nawash et al. | |
| 4,863,438 | A | | 9/1989 | Gauderer et al. | |
| 5,112,308 | A | * | 5/1992 | Olsen et al. | 604/164.09 |
| 5,207,651 | A | * | 5/1993 | Snyder | 604/174 |
| 5,242,427 | A | * | 9/1993 | Bilweis | 604/264 |
| 5,248,302 | A | * | 9/1993 | Patrick et al. | 604/178 |
| 5,290,249 | A | * | 3/1994 | Foster et al. | 604/174 |
| 5,336,203 | A | * | 8/1994 | Goldhardt et al. | 604/247 |
| 5,472,427 | A | * | 12/1995 | Rammler | 604/164.01 |
| 5,484,420 | A | * | 1/1996 | Russo | 604/178 |
| 5,556,411 | A | * | 9/1996 | Taoda et al. | 606/185 |
| 5,735,867 | A | * | 4/1998 | Golser et al. | 606/185 |
| 5,935,107 | A | * | 8/1999 | Taylor et al. | 604/164.04 |
| 6,589,208 | B2 | * | 7/2003 | Ewers et al. | 604/104 |
| 6,632,197 | B2 | * | 10/2003 | Lyon | 604/107 |
| 6,984,221 | B1 | * | 1/2006 | Scheye | 604/178 |
| 7,083,595 | B2 | * | 8/2006 | Chu et al. | 604/107 |
| 2002/0058910 | A1 | * | 5/2002 | Hermann et al. | 604/95.04 |

FOREIGN PATENT DOCUMENTS

| | | |
|---|---|---|
| JP | 62-254769 | 11/1987 |
| JP | 4-226676 | 8/1992 |
| JP | 4-263870 | 9/1992 |
| JP | 5-137792 | 6/1993 |
| JP | 11-309215 | 11/1999 |
| JP | 3347315 | 9/2002 |

* cited by examiner

CATHETER KIT FOR BURROW

TECHNICAL FIELD

The present invention relates to a catheter kit for a fistula excellent in operability used in percutaneous endoscopic gastrostomy which is performed for the purpose of replenishing a nutritional supplement or a drug.

BACKGROUND TECHNIQUE

As a method of administering a nutrient to a patient who can not ingest a nutrient orally, generally, there are three administration methods of pervenous nutrient administration, stomach tube nutrient administration which is performed by inserting a nutrient tube into stomach or intestine nasally, and enteral nutrient administration though a gastric fistula. In recent years, with development of an enteral nutrient and a method of administering it, enteral nutritional management by percutaneous endoscopic gastrostomy (PEG) has been frequently performed. Since in PEG, a fistula is made by small operation, invasion is small as compared with surgical laparotomic gastrostomy, and a medical cost can be considerably reduced, therefore, PEG has become a standard format of gastrostomy in Europe and USA. The catheter kit for a fistula is for carrying out this PEG and, specifically, for percutaneously replenishing a nutrient or a drug solution into stomach from outside a body.

Previously, various catheter kits for a fistula have been proposed. Generally, the catheter kit for a fistula is constructed of a catheter having a lumen for replenishing a nutrient or a drug solution into stomach from outside a body, and an internal indwelling part provided at a tip part of the catheter, which is positioned in a body in the embedded state, and prevents the catheter from being evulsed from stomach. If necessary, the kit also has a flat extracorporeal fixing part at a rear end of a tube so that the tube is not embedded in stomach.

Hitherto, this internal indwelling part is usually formed of a balloon having a thin shell, and is constructed so that dilation and constriction of the internal indwelling part can be selected by supplying a fluid to the balloon and discharging a fluid from the balloon. However, when the internal indwelling part is a balloon-type, it is unexpectedly deformed due to damage such as rupture thereof, the embedded state of a catheter in stomach can not be maintained, and there is a possibility that the catheter is evulsed from stomach.

U.S. Pat. No. 4,863,438 which is a patent reference 1 discloses a catheter kit for a fistula which solves these disadvantages. This catheter kit for a fistula is provided with a non-balloon-type internal indwelling part which is elastically deformed by an external force and, in the free state, is in the state where it is projected from the catheter outwardly in its radial direction and, in the state where an external force is acted, a projection area obtained by projecting the internal indwelling part on the same axis as that of the catheter is reduced than that of the projected state.

According to the same manner as that of to this catheter kit for a fistula, when the catheter is inserted into stomach from outside a body, a rod-like obturator is inserted into a tip part of the catheter inside or outside the catheter and, by further pushing in the obturator, the internal indwelling part is pushed and extended elastically. In this state, the catheter together with the obturator is inserted into stomach. After insertion, by evulsion of only the obturator from the balloon, the internal indwelling part is returned to the projected state. Like this, since the internal indwelling part is a non-balloon-type, after the catheter is embedded in stomach, a possibility of unexpected deformation is small, and evulsion of the catheter from stomach is prevented, unlike a balloon type.

However, although it is disclosed that the catheter is inserted in stomach from outside a body via a fistula which has been already provided in a patient, a specific method therefor is not disclosed. When a fistula is provided, a penetrating pore is formed in an abdominal wall and a stomach wall of a patient with a needle or the like, and the catheter is inserted into the penetrating pore. Upon this insertion, a stomach wall is fixed with a suture thread so that the stomach wall is not freely moved relative to an abdominal wall, but actually, it is difficult to completely fix it, and when a stomach fistula is not properly provided, acute peritonitis is caused in some cases.

Japanese Patent No. 3347315 which is a patent reference 2 discloses a catheter kit for a stomach fistula 500 which solves a problem at provision of this fistula, and comprises a catheter 100, and has in an interior thereof a hollow rod 200 which is evulsibly engaged with an internal indwelling part 102 provided below a tube 101 and, in this engaged state, transmits an external force to the internal indwelling part 102 from outside a body and has an in-rod passage 202 through which a guidewire 400 is inserted, wherein the internal indwelling part 102 has a communicating passage 105 for making an in-rod-passage 202 communicate with a space in stomach in the engaged state, as shown in FIG. 21 and FIG. 22. The guidewire 400 is passed through the hollow rod 200, and the hollow rod 200 has function as an obturator.

Specifically, since central axes of penetrating pores 303 of a stomach wall 302 and an abdominal wall 301 are not consistent, and the catheter 100 can not be properly inserted, by passing the guidewire 400 through the penetrating pores 303, and aligning the penetrating pores 303 of an abdominal wall 301 and a stomach wall 302 along the guidewire 400, an insertion route for the catheter is made to be proper, the guidewire 400 is passed through the in-rod passage 202 and a communicating passage 105 in an assembly of the hollow rod 200 and the pushed and expanded internal indwelling part 102, and the catheter 100 is inserted into stomach from outside a body. However, in the catheter kit described in Japanese Patent No. 3347315, when the internal indwelling part 102 of the catheter 100 is elastically deformed from the free state into the external force acting state, since the guidewire passage 202 is passed through an operating part 201 of the hollow rod 200, the guidewire 400 becomes an obstacle when the operating part 201 of the hollow rod 200 is pushed with a finger, this makes a worker be conscious of avoiding the guidewire 400 (FIG. 22). Alternatively, it is also contemplated that the operating part 201 is configured to be greatly expanded outwardly in a radial direction of the hollow rod 200 so that the guidewire 400 does not become an obstacle. However, in this case, since a direction that the preparing part 201 of the hollow rod 200 is pushed with a finger is outside of a central axis of the hollow rod 200, there is a problem that a force is not effectively transmitted from the hollow rod 200 to the internal indwelling part 102 of the catheter 100.

On the other hand, since a whole catheter used in the previous catheter kit for a fistula is formed of an elastic material, when an external force is acted with an obturator or a hollow rod, not only an internal indwelling part, but also a tube which is not necessary to be pushed and expanded are pushed and expanded meaninglessly. That is, as shown in FIG. 22, a length $l_1$ of the tube 101 in the free state becomes a length $l_2$ ($>l_1$) in the external force acting state. In this case, since an external force is not concentrated on the internal indwelling part, operation for further enhancing an external force is performed in some cases, and operation of inserting into a body becomes more difficult. In addition, in the previous catheter kit for a fistula, there is a problem that, when one tries to push and expand an internal indwelling part with an obturator or a hollow rod, at an abutment part, an obturator or a hollow rod breaks a tip of an internal indwelling part, projecting therefrom, and the internal indwelling part can not be inserted in a body. Further, the previous catheter kit for a fistula has a problem that operation of pushing and expanding an internal indwelling part 102 of the catheter 100, and operation of inserting the catheter 100 in stomach must be done at the same time, and an operating ability and operation technique are required as compared with a method of successively performing individual operations.

(Patent Reference 1) U.S. Pat. No. 4,863,438

(Patent Reference 2) Japanese Patent No. 3347315 (claims 1 to 3, FIGS. 5-7)

Accordingly, an object of the present invention is to provide a catheter kit for a fistula having improved operability upon insertion into a fistula of a catheter kit which is used in percutaneous endosopic gastrostomy.

DISCLOSURE OF THE INVENTION

That is, the present invention provides a catheter kit for a fistula, comprising a catheter for percutaneously replenishing a nutrient or a drug solution into stomach of a patient from outside a body and an obturator, wherein the catheter has a tube extending along a wall surface of a fistula which has in an interior thereof a nutrient passage for introducing a nutrient or a drug solution into stomach from outside a body, a non-balloon-type internal indwelling part which is provided at a tip part of the tube, is in the projected state where a diameter of the part is expanded outwardly in a radial direction of the tube, in which a diameter thereof is reduced from the projected state by action of an external force with an obturator, and which is indwelled in stomach in the state of embedment in a living body, an extracorporeal fixing part which is provided at a rear end of the tube and is projected in a radial direction of the tube, and a communicating pore which is provided at a tip part of the internal indwelling part and is for making a guidewire passage of the obturator communicate with an interior of stomach from outside a body, the obturator is evulsibly engaged with the catheter until it abuts against the internal indwelling part, and has a guidewire passage which is provided from a tip thereof to midway and through which a guidewire is passed, and an operating part which is provided at a rear end thereof and transmits an external force to the internal indwelling part, and a rear end part of the guiedwire passage and the operating part are arranged in the isolated state.

Also, the present invention provides the aforementioned catheter kit for a fistula, wherein the obturator is evulsibly engaged with a tube of the catheter, and has an external diameter slightly smaller than an internal diameter of the tube.

In addition, the present invention provides the aforementioned catheter kit for a fistula, wherein the guidewire passage which is provided from a tip of the obturator to midway is a hollow part or a groove part. In addition, the present invention provides the aforementioned catheter kit for a fistula, further comprising a guidewire which is used by inserting through the communicating pore and the guidewire passage and, in its inserted state, induces insertion of an assembly of the internal indwelling part, the tube and the obturator into stomach from outside a body via the fistula.

In addition, the present invention provides the aforementioned catheter kit for a fistula, wherein the internal indwelling part is constructed as a malecot shape with two or more arms, and is provided with a notch inside a seam part between arms on a tip side of the internal indwelling part and on a rear end side of the internal indwelling part, or on either side.

In addition, the present invention provides the catheter kit for a fistula, wherein an expanded diameter length (diameter) of the internal indwelling part in the free state is greater than a length in an axial direction of the tube, thereby, the internal indwelling part is flat-shaped.

In addition, the present invention provides the catheter kit for a fistula, wherein a projection is further provided at a tip of the internal indwelling part.

In addition, the present invention provides the aforementioned catheter kit for a fistula, wherein a tip part of the tube is further provided with a one-way valve for preventing a counterflow from an interior of stomach to outside of a body via a nutrient passage.

In addition, the present invention provides the aforementioned catheter kit for a fistula, wherein a tip of the obturator of the internal indwelling part has the abutting part reinforced with a reinforcing member.

In addition, the present invention provides the aforementioned catheter kit for a fistula, wherein the reinforcing member is a mesh made of a metal.

In addition, the present invention provides the aforementioned catheter kit for a fistula, further comprising an external cylinder which is evulsibly engaged with a tube of the catheter, and has a regulating part for regulating deformation of a tube, which has an external diameter slightly smaller than an internal diameter of the tube, and an obturator passage with which the obturator is slidably engaged.

In addition, the present invention provides the aforementioned catheter kit for a fistula, further comprising a lock mechanism which consists of a projection provided on the obturator and two lock pores provided on the external cylinder, and determines a position of a tip of the obturator into arbitrary two positions relative to a position of a tip of the external cylinder, by fitting between the projection and the lock pore.

In addition, the present invention provides the aforementioned catheter kit for a fistula, wherein a stopper for regulating movement of the catheter relative to the external cylinder when a diameter of the internal indwelling part is reduced by the action of an external force is further provided on a base end part of the external cylinder.

In addition, the present invention provides the catheter kit for a fistula, wherein a finger hook which is projected outwardly in an axial direction of the external cylinder is further provided above the stopper and at a base end part of the external cylinder.

According to the present invention, since a rear part of a guidewire passage and an operating part in an obturator are arranged in the isolated state, and a guidewire does not become an obstacle when an operating part of the obturator is pushed with a finger, a worker does not need to mind a guidewire. In addition, when a center (axial core) of an operating part of the obturator is pushed with a finger, a force is well transmitted to an internal indwelling part of the catheter effectively.

In addition, according to the present invention, the same effect as that of the aforementioned invention is exerted, additionally, an acting force with the obturator can be concentrated on an internal indwelling part without pushing and expanding a tube meaninglessly. For this reason, operation for inserting a catheter into a body becomes easy.

In addition, according to the present invention, the same effect as that of the aforementioned invention is exerted, additionally, a guidewire can be assuredly inserted into an obturator. In particular, when a guidewire passage is a groove part, an obturator can be manufactured at a lower cost than the case where a guidewire passage is a hollow part.

In addition, according to the present invention, the same effect as that of the aforementioned invention is exerted, additionally, an assembly of a catheter and an obturator can be assuredly inserted into stomach from outside a body via the fistula by guidance of a guidewire.

In addition, according to the present invention, the same effect as that of the aforementioned invention is exerted, additionally, when a catheter is inserted into stomach, a projected area obtained by projecting on the same axis as that of an internal indwelling part can be reduced than that in the free state with a smaller force as compared with the previous kit, a burden imposed on a patient can be alleviated, operability of an operator is enhanced, and shortening of a working time can be expected.

In addition, according to the present invention, the same effect as that of the aforementioned invention is exerted, additionally, a catheter for a fistula can be stabilized at an abdominal part of a patient.

In addition, according to the present invention, the same effect as that of the aforementioned invention is exerted, additionally, when a catheter is inserted into a fistula, positioning of an internal indwelling part relative to a fistula is easy, and workability of an operator can be improved.

In addition, according to the present invention, the same effect as that of the aforementioned invention is exerted, additionally, a nutrient or a drug solution can be percutaneously replenished into stomach of a patient from outside a body and, at the same time, a liquid substance is not reversely flown from an interior of stomach to outside of a body.

In addition, according to the present invention, the same effect as that of the aforementioned invention is exerted, additionally, even when an external force is acted on an internal indwelling part with an obturator, the obturator does not break a tip of the internal indwelling part, projecting therefrom, and an internal indwelling part can be easily and assuredly inserted into a body in the diameter-reduced state.

In addition, according to the present invention, the same effect as that of the aforementioned invention is exerted, additionally, while the state where an internal indwelling part of a catheter is pushed and expanded is locked, a catheter can be inserted into stomach, and operation becomes further easy.

BRIEF DESCRIPTION OF THE DRAWINGS

FIG. 19 is a longitudinal cross-sectional view of an assembly of the catheter kit of this example in the free state.

BEST MODE FOR CARRYING OUT THE INVENTION

Figure 1:
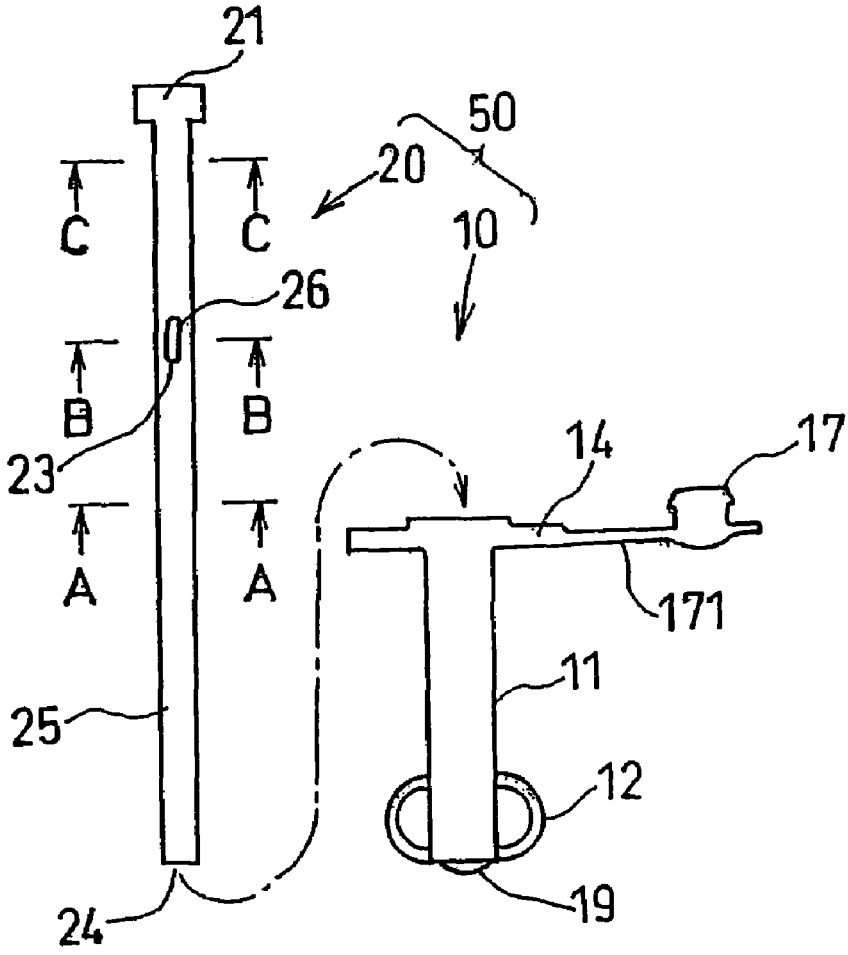
FIG. 1 is a schematic view of a catheter and an obturator constituting the catheter kit for a fistula in the free state of the present example.
Figure 2:
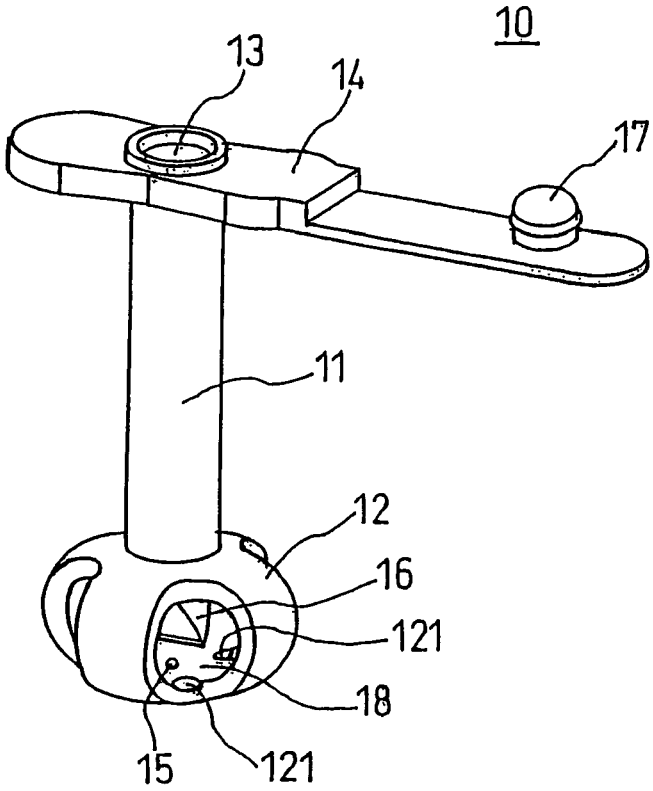
FIG. 2 is a perspective of the catheter of FIG. 1.
Figure 3:
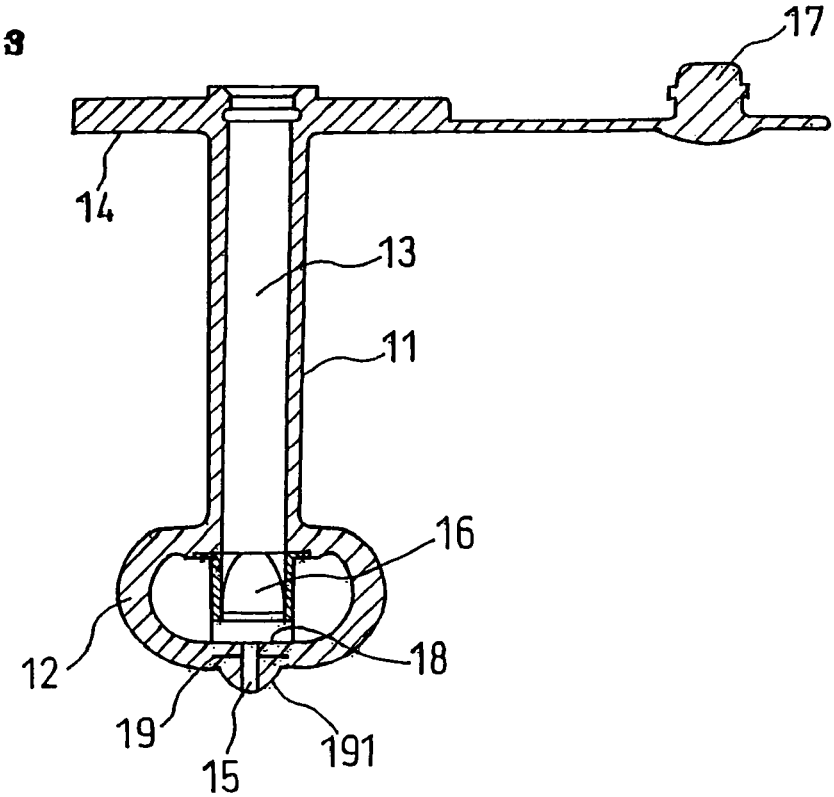
FIG. 3 is a longitudinal cross-sectional view of the catheter of FIG. 1, FIG. 4 (A) is an enlarged end view seen along an A-A line of FIG. 1, (B) is an enlarged end view seen along a B-B line of FIG. 1, (C) is an enlarged end view seen along a C-C line of FIG. 1.
Figure 4:
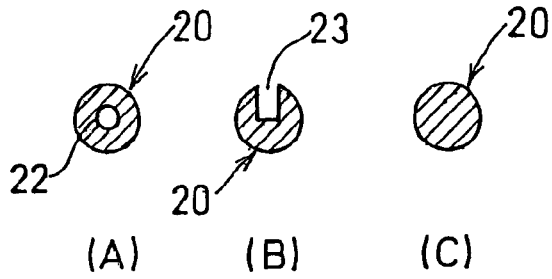
Figure 5:
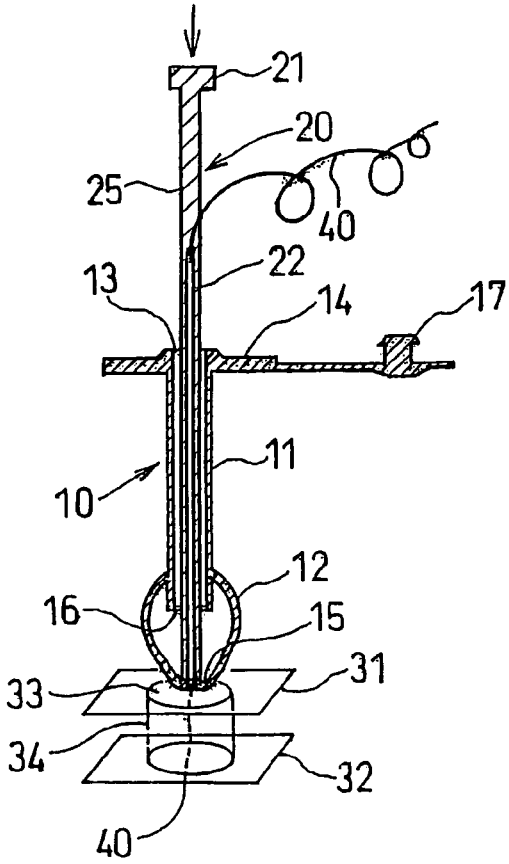
FIG. 5 is a schematic view of a catheter kit for a fistula in the external force acting state of this example.
Figure 6:
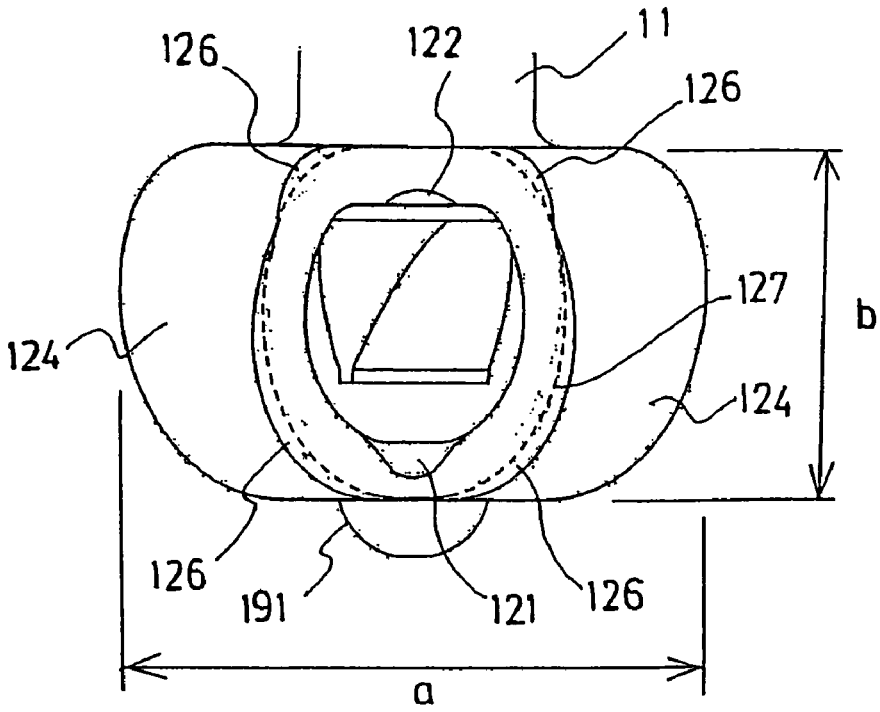
FIG. 6 is an enlarged view of a tip part of the catheter of FIG. 1.
Figure 7:
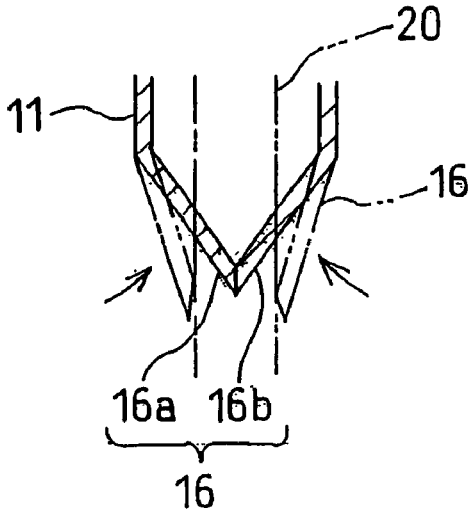
FIG. 7 is an illustration view showing one example of a one-way valve, FIG. 8 (A) is a front view of an obturator used in a catheter kit of a second embodiment, (B) is a right side view of FIG. 8 (A), FIG. 9 (A) is a view seen along a D-D line of FIG. 6, (B) is a view seen along an E-E line of FIG. 8, FIG. 10 (A) is a front view of an external cylinder used in the catheter kit of this example, (B) is a right side view of FIG. 10 (A), FIG. 11 (A) is a view seen along a F-F line of FIG. 10, (B) is a view seen along a G-G line of FIG. 10.

Then, the catheter kit for a fistula in the first embodiment of the present invention will be explained by referring to FIG. 1 to FIG. 7. FIG. 1 is a schematic view of a catheter and an obturator constituting the catheter kit for a fistula in the free state of this example, FIG. 2 is a perspective of the catheter of FIG. 1, FIG. 3 is a longitudinal cross-sectional view of the catheter of FIG. 1, FIG. 4 (A) is an enlarged end view seen along an A-A line of FIG. 1, (B) is an enlarged end view seen along a B-B line of FIG. 1, (C) is an enlarged end view seen along a C-C line of FIG. 1, FIG. 5 is a schematic view of the catheter kit for a fistula in the external force acting state of this example, FIG. 6 is an enlarged view of a tip part of the catheter of FIG. 1, and FIG. 7 is an illustration view showing one example of a one-way valve. Herein, the "tip" refers to a side in a body, and the "rear end" refers to an extracorporeal side.

The catheter kit for a fistula 50 in the first embodiment is constructed of a catheter 10 and an obturator 20, and percutaneously replenishes a nutrient or a drug solution into stomach of a patient from outside a body.

The catheter 10 is formed of an elastic material, has in an interior thereof a nutrient passage 13 for introducing a nutrient or a drug solution into stomach from outside a body and, at the same time, has a tube 11 which extends along a wall surface 34 of a fistula 33, a non-balloon type internal indwelling part 12 which is provided at a tip part of the tube 11, and an extracorporeal fixing part 14 which is provided at a rear end of the tube so that the internal indwelling part 12 and the tube 11 are not embedded in stomach, and is positioned extracorporeally.

The internal indwelling part 12 is provided at a part situated in stomach of a patient in the state where the catheter 10 is embedded in a body, and prevents the catheter 10 from being evulsed from a patient. That is, the internal indwelling part 12 is formed of a material which can be elastically deformed, is projected in the free state so that a diameter is expanded outwardly in a radial direction of the tube 11, a diameter thereof is reduced from the projected state by action of an external force with an obturator 20 and, at the same time, is indwelled in stomach in the state of embedment in a living body (FIG. 5).

The internal indwelling part 12, in the free state, is of such a shape that function of preventing evulsion of the catheter 10 is exerted and, in the external force acting state, a shape thereof is not particularly limited as far as it is such a shape that the catheter is easily inserted into a fistula 33. For example, as shown in FIG. 6, there is an example in which the part is formed in a malecot manner of two or more arms 124, and notches 121, 122 are provided inside a seam (crotch) part between arms on a tip side of the internal indwelling part and on a rear end side of the internal indwelling part. Notches 121, 122 may be provided only on either side. By provision of notches 121, 122, in the external force acting state of the internal indwelling part 12, bulkiness of a seam part between arms 124 can be reduced, a burden on a patient accompanied with insertion of the catheter 10 into a fistula, and evulsion work can be reduced, and workability of an operator can be improved.

In addition, it is preferable that a corner part (edge) 127 of an arm 124 of the internal indwelling part 12 is subjected to gradual change R procession in that a shape of the internal indwelling part 12 in the external force acting state can approach the same shape as that of a tube 11, that is, a linear shape having no bulkiness. Since normal R procession R-processes all corner parts at the same size, a wall thickness of the arm as a whole is the same, while gradual change R procession adopts further greater R only at a corner part of a part 126 which becomes bulky in the external force acting state, thereby, a wall thickness at that part is reduced, and a wall thickness of a whole arm is ununiformized.

In addition, the internal indwelling part 12 has desirably a flat shape in which a diameter a which is expanded outwardly in a radial direction of a tube 11 is greater than a length b of the tube in an axial direction. Thereby, in the state where a catheter is inindwelled in an interior of stomach of a patient, stimulation on a stomach bottom of a patient can be decreased.

A tip part of the internal indwelling part 12 further has an abutting part 18 on which an external force acts. The abutting part 18 is a part against which a tip 24 of an obturator 20 abuts, and which is pulled into an interior of a body. In addition, this abutting part 18 is provided with a communicating pore 15 which plays function of communicating between outside of a body and an interior of stomach, in corporation with a guidewire passage 22 of an obturator 20. Thereby, when a guidewire 40 described below is passed through a communicating pore 15 and a guidewire passage 22, an assembly of a tube 11 and an obturator 20 can be assuredly inserted into stomach from outside a body via a fistula, by guidance of a guidewire 40.

This abutting part 18 is reinforced with a reinforcing member 19 and, even when an external force is acted on an internal indwelling part 12 with an obturator 20, the obturator 20 does not break a tip of an internal indwelling part 12, projecting therefrom, and is preferable that an internal indwelling part 12 can be easily and assuredly inserted in a body in the diameter-reduced state. A shape and a material of the reinforcing member 19 are not particularly limited as far as function of communicating between outside of a body and an interior of stomach in corporation of a communicating pore 15 provided on an internal indwelling part 12, and a guidewire passage 22 of an obturator 22 is not deteriorated, but examples include a reinforcing member formed of a material such as a metal and a thermosetting resin, and it is particularly preferable that the material is a mesh made of ametal. Thereby, the abutting part 18 becomes in the state where the reinforcing member 19 is embedded in a resin, an area of contact between the mesh made of a metal and an elastically deforming material is expanded, and an intensity can be improved.

An extracorporeal fixing part 14 is provided at a part which is positioned outside a body of a patient in the catheter embedment state, and prevents the catheter 10 from being embedded in a body of a patient. A shape of the extracorporeal fixing part 14 is such that the part is projected at a rear end of a tube 11 and is projected in a radial direction of the tube 11, and examples include a flat part which is provided at a periphery of an opening at a rear end of a nutrient passage 13. Since the extracorporeal fixing part 14 is only a part which can be seen to a patient among the catheter 10, when the part is flat, it is preferable in that the part has little bulkiness, and does not hamper a life of a patient. In addition, a plug 17 fitting with an opening at a rear end of a nutrient passage 13 is attached to the extracorporeal fixing part 14 of this example via a communicating member 171. The plug 17 can retain air tightness in stomach by fitting of the plug 17 with an opening of a nutrient passage 13 when a nutrient or a drug solution is not percutaneously replenished into stomach from outside a body, in the catheter embedment state.

In addition, the catheter 10 is preferably provided with a one-way valve 16 which is provided at a tip part of a tube 11, that is, an exit of a nutrient passage 13 in that a nutrient or a drug solution can be percutaneously replenished into stomach of a patient from outside a body and, at the same time, a liquid substance is not reversely flown from an interior of stomach to outside of a body. As the one-way valve 16, the known valve can be used, but examples include a one-way valve which is constructed of one pair of valve members 16*a*, 16*b* extending from a tip of a tube 11 as shown in FIG. 7, and in which since an internal pressure shown by an arrow is applied in a normal body, one pair of valve members 16*a*, 16*b* are closed to form the air tight state and, in the state of replenishing a nutrient, one pair of valve members 16*a*, 16*b* are opened.

In addition, a projection 191 is provided on an outer wall surface at a tip of the internal indwelling part 12. This projection 191 is of a generally hemicircular cross-section shape, and its maximum diameter is approximately the same as a diameter of the tube 11. Thereby, a positional relationship of the internal indwelling part 12 relative to a fistula can be easily seen with naked eyes at insertion of the catheter 10 into a fistula, and workability of an operator can be improved. A size of the projection is not particularly limited, but its maximum diameter may be smaller than a diameter of the tube 11.

The internal indwelling part 12, the tube 11, the extracorporeal fixing part 14, the one-way valve 16 and the reinforcing member 19 forming the catheter 10 are usually manufactured by compression molding and, preferably, manufactured by integral molding.

Obturator 20 is evulsibly engaged with the tube 11 of the catheter, and preferably has an external diameter slightly smaller than an internal diameter of the tube 11 in that an acting force with the obturator can be concentrated on the internal indwelling part without pushing and expanding the tube meaninglessly. In addition, the obturator 20 is evulsibly engaged with the catheter 10 until abutment against the internal indwelling part 12, has a guidewire passage 22 which is provided from a tip of a rod part 25 to midway, and is for inserting a guidewire 40, and an operating part 21 which is provided at its rear end and is for transmitting an external force to the internal indwelling part 12, and a rear part 23 of the guidewire passage 22 and the operating part 21 are arranged in the isolated state. The obturator 20 is usually manufactured by injection molding. By arranging a rear end part 23 of the guidewire passage 22 and the operating part 21 in the isolated state, a guidewire 40 does not become an obstacle when the operating part 21 of the obturator 20 is pushed with a finger. In addition, a center (axial core) of the operating part 21 of the obturator 20 can be pushed with a finger, and a force is effectively transmitted to the internal indwelling part 12 of the catheter 10.

The guidewire passage 22 is not particularly limited, but in the present example, is a hollow part of a circular cross-section having an internal diameter greater than a diameter of a guidewire. A minimum length of a guidewire passage 22 forming part, that is, from a tip of a rod part 25 to midway is not particularly limited, but is preferably greater than a maximum length of a catheter in the external force acting state in respect of easy handling such as easy insertion of a guidewire 40. In addition, in the guidewire passage 22, its rear end part is connected to an opening window 26 of a rod part 25, communicating with the outside. Thereby, the guide wire 40 is used by communicating with a communicating pore 15, a guidewire passage 22 and an opening window 26 of the catheter 11 and, at the same time, in the inserted state, can guide insertion of an assembly of the internal indwelling part 12, the tube 11 and the obturator 20 into stomach from outside a body via a fistula 33.

Then, a method of using the catheter kit for a fistula of the first embodiment will be explained. The method of using the catheter kit for a fistula of this example is to successively perform a patient side pre-treatment step, a pre-step of inserting a catheter kit into stomach, and a step of inserting a catheter kit into stomach. The patient side pre-treatment step is a step until a stomach wall and an abdominal wall of a patient are fixed. That is, first, an endoscope is inserted into stomach of a patient, air supply is sufficiently performed, and an abdominal wall 31 and a stomach wall 32 are adhered. Then, a position of stomach is confirmed by light transmitted from an endoscope, an abdominal skin is disinfected, and local anesthesia is performed. Subsequently, at that site, stomach wall and abdominal wall fixation is performed in order to prevent slippage of a relative position of an abdominal wall 31 and a stomach wall 32. A small incision is added to a vicinity of this stomach wall and abdominal wall fixation with a surgical knife. This site is a site at which a catheter 10 is planned to be inserted.

In a pre-step of inserting a catheter kit into stomach, first, a hollow needle or a needle with a sheath is penetrated through a small incision site, in an order of an abdominal wall 31 and a stomach wall 32, to form an insertion pore. A guidewire 40 is inserted into the insertion pore until stomach via an internal cavity of the hollow needle or the sheath. After completion of insertion, the hollow needle or the needle with a sheath is evulsed from a patient while the guidewire 40 is left. Prior to insertion of the catheter 10 into stomach, a sufficient long length of the guidewire 40 is inserted into stomach so that the guidewire 40 is not pulled out contrary to expectations during afterward operation.

Then, operation of expanding a diameter of an insertion pore 33 is performed. For example, a dilator is inserted into the insertion pore 33 along the guide wire 40. After completion of expansion operation, the dilator is evulsed from a patient while the guidewire 40 is left. Then, an obturator 20 is inserted through an opening of a rear end of a tube 11. A communicating pore 15 of an internal indwelling part 12, a guidewire passage 22 of the obturator 20, and an opening window 26 are passed in this order through the guidewire 40 exited outside a body from the insertion pore 33, and a catheter 10 is inserted toward stomach. Thereupon, a tip 24 of the obturator 20 is in the free state where it is abutted against an abutting part 18 of an internal indwelling part 12, and the internal indwelling part 12 is in the projected state where a diameter is expanded outwardly in a radial direction of a tube 11.

Then, by further pushing an operating part 21 of an obturator 20, a diameter of the internal indwelling part 12 is reduced than that in the projected state by action of an external force with an obturator 20 and, at the same time, the part is deformed into the external force acting state (FIG. 5). In this state, a guidewire passage 22 of an obturator 20 which is used by inserting a guidewire 40, and a communicating pore 15 provided at an abutting part 18 are in the insertion state. Like this, operation of pushing an operating part 21 of an obturator 20 with a finger can push a central part (axis core) of the operating part 21 without minding the guidewire 40 since an opening window 26 which is a rear end part of the guidewire 40, and an operating part 21 are in the isolated state. A timing at which the guidewire 40 is inserted into a communicating pore 15 of an internal indwelling part 12, a guidewire passage 22 and an opening window 26 is not limited to the aforementioned timing, but insertion may be performed after an internal indwelling part 12 is brought into the external force acting state.

Then, a step of inserting a catheter kit into stomach is performed. The step of insertion into stomach is a step of inserting an assembly of a catheter 10 containing an internal indwelling part 12 which has been elastically deformed and has a diameter reduced than the projected state, and an obturator 20 into stomach along a guidewire 40. By guidance of the guidewire 40, an internal indwelling part 12 is inserted into stomach, and an extracorporeal fixing part 14 at a rear end of a tube 11 is abutted against an abdominal wall 31 of a patient, at which insertion is stopped. In insertion of a catheter kit into stomach, since taking out of a guidewire 40 from an obturator 20 is isolated from an operating part 21, the catheter kit can be inserted without minding a guidewire 40 which is outside therefrom. Then, by weakening an operating force applied to an operating part 21 of an obturator 20, the internal indwelling part 12 in the external force acting state is returned to the free state. Thereby, function of preventing evulsion of a catheter 10 from a patient is also recovered.

In the catheter 10 which has been inserted into stomach by such the method, when a nutrient or a drug solution is not percutaneously replenished into stomach of a patient from outside a body, by fitting a plug 17 provided on an extracorporeal fixing part 14 with an opening at a rear end of a tube 11, air tightness in stomach can be retained. In addition, when a nutrient or a drug solution is percutaneously replenished into stomach of a patient from outside a body, treatment of nutrient replenishment can be performed by eliminating fitting between the plug 17 and a nutrient passage 13.

According to the catheter kit for a fistula in the first embodiment, since a rear end part of a guidewire passage and an operating part in an obturator are arranged in the isolated state, a guidewire does not become an obstacle when an operating part of an obturator is pushed with a finger, therefore, a worker does not need to mind a guidewire. In addition, when a center of an operating part of an obturator is pushed with a finger, a force is effectively transmitted to an internal indwelling part of the catheter. In addition, by guidance by a guidewire, an assembly of a catheter and an obturator can be assuredly inserted into stomach from outside a body via a fistula.

Figure 8:
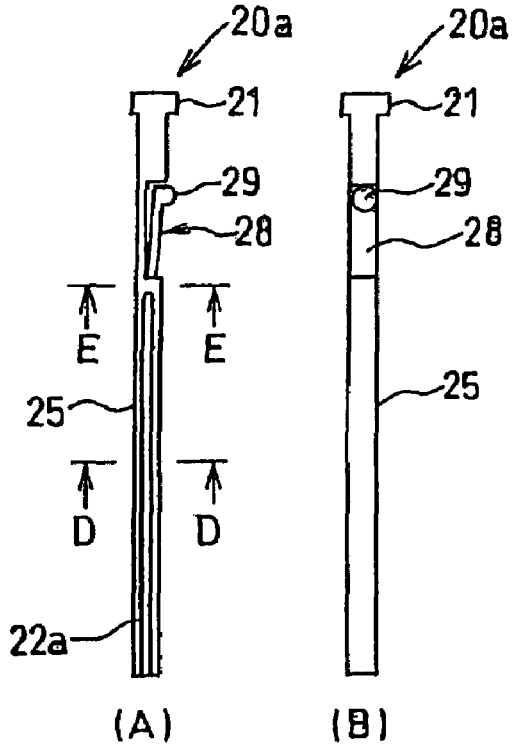
Figure 9:
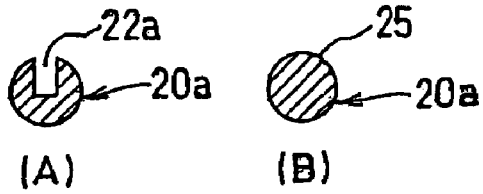
Figure 10:
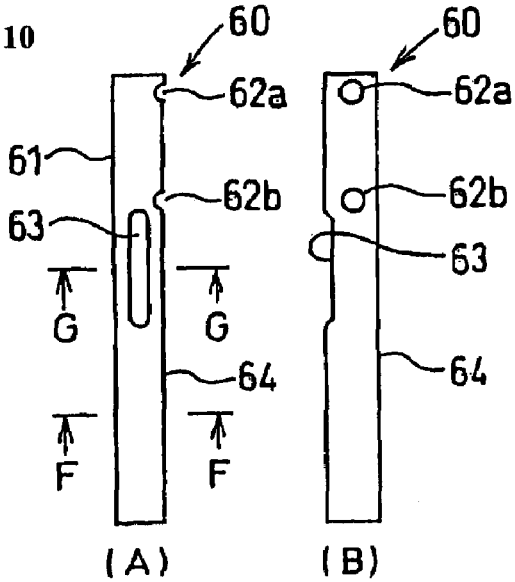
Figure 11:
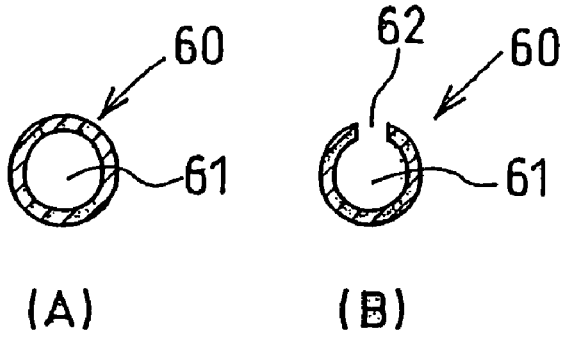
Figure 12:
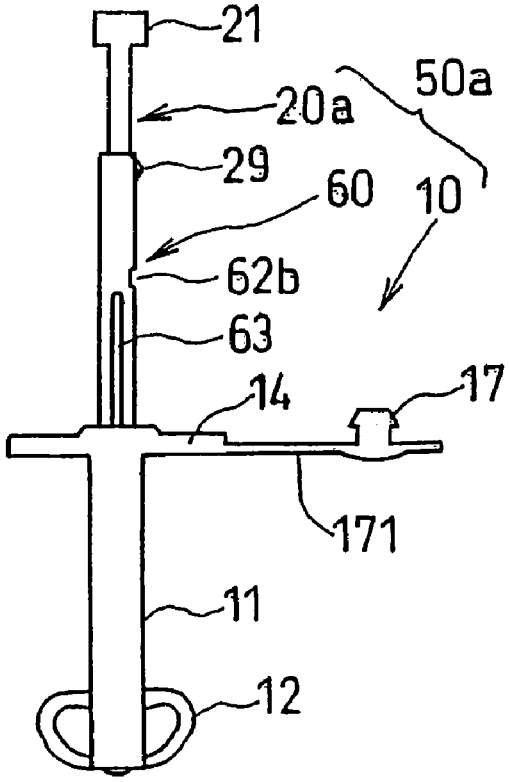
FIG. 12 is a schematic view of an assembly of the catheter kit of this example in the free state.
Figure 13:
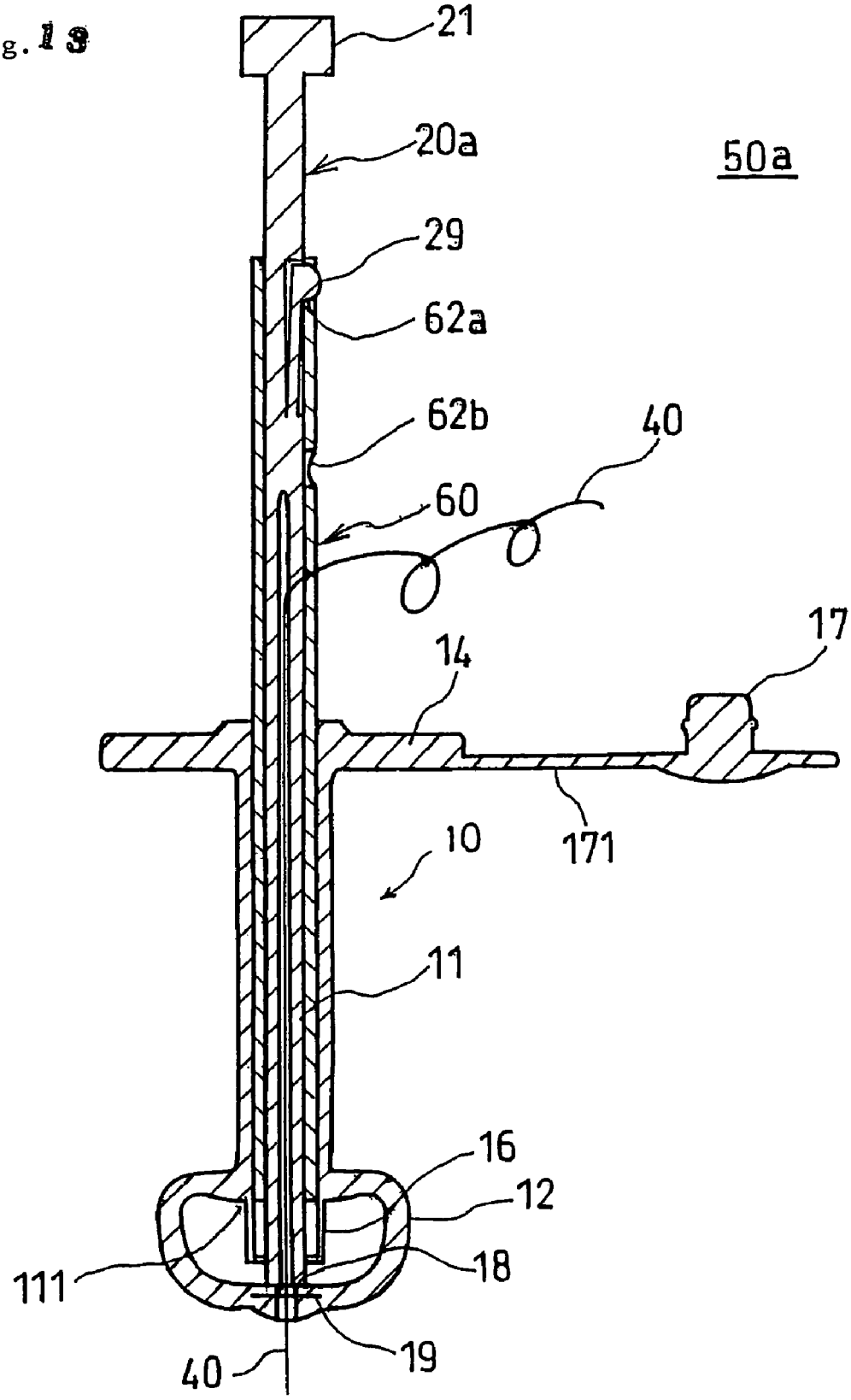
FIG. 13 is a longitudinal cross-sectional view of FIG. 12.
Figure 14:
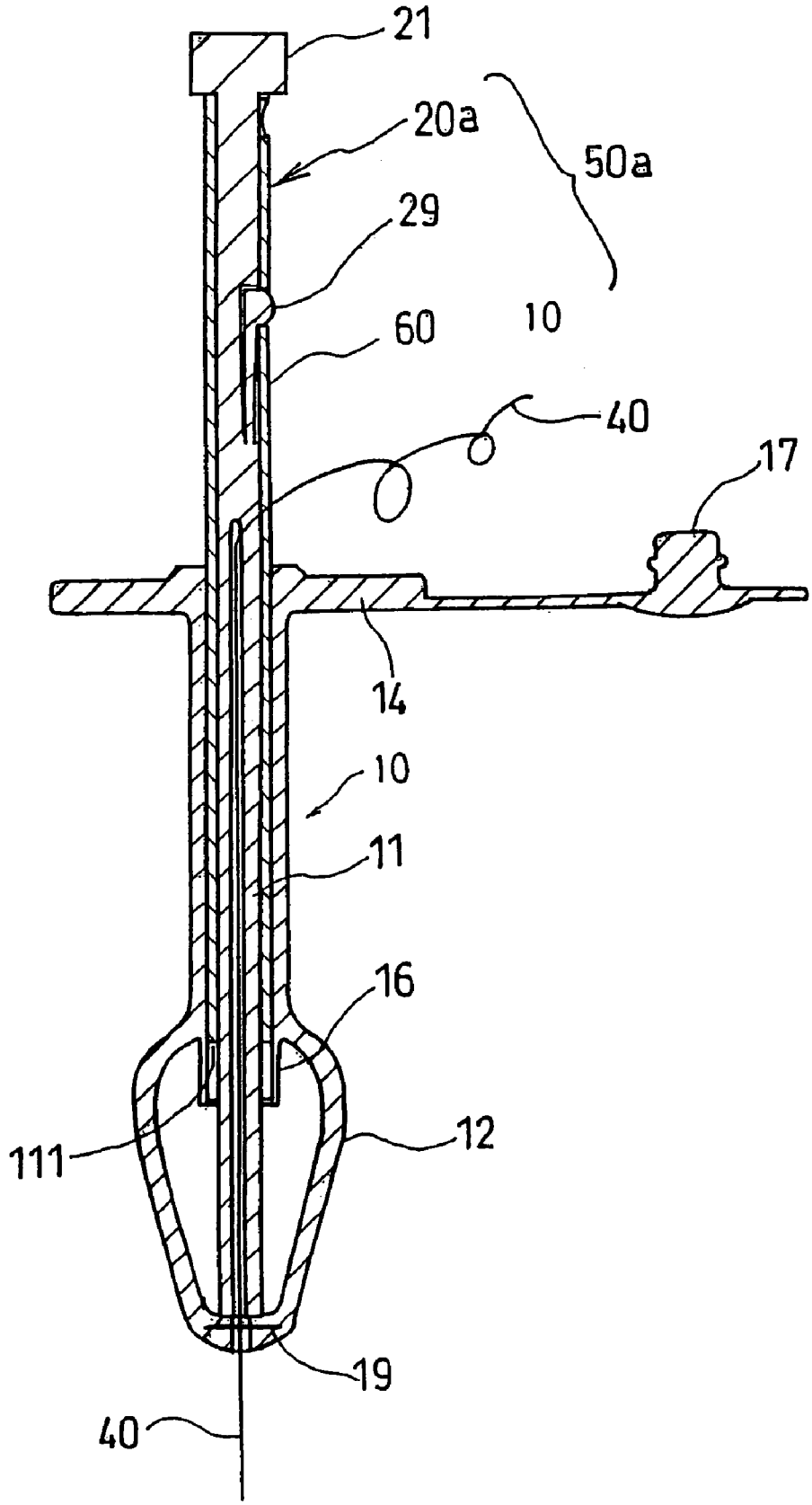
FIG. 14 is a schematic view of an assembly of the catheter kit of this example in the external force acting state.
Figure 15:
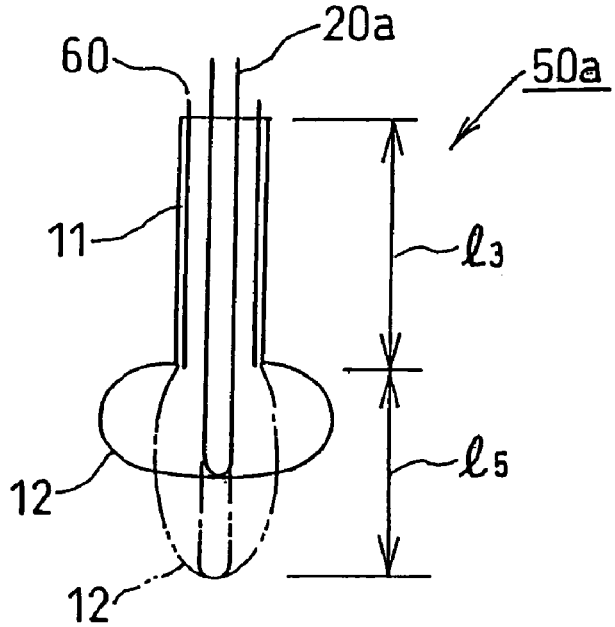
FIG. 15 is a view for explaining the tube deformation suppressing activity in the catheter kit of this example.
Figure 16:
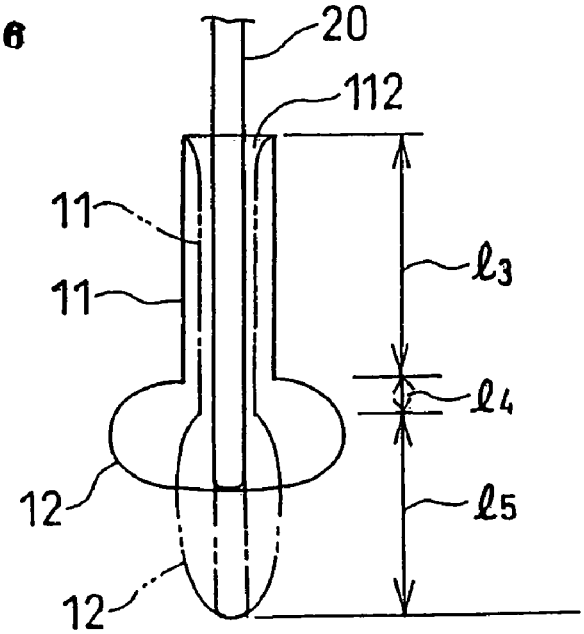
FIG. 16 is a view for explaining tube deformation in the previous catheter kit.

Then, the catheter kit for a fistula in a second embodiment will be explained by referring to FIG. 8 to FIG. 15. FIG. 8 (A) is a front view of an obturator used in the catheter kit of this example, FIG. 8 (B) is a right side view of FIG. 8 (A), FIG. 9 (A) is a view seen along a D-D line of FIG. 8, FIG. 9 (B) is a view seen along an E-E line of FIG. 8, FIG. 10 (A) is a front view of an external cylinder used in the catheter kit of this example, FIG. 10 (B) is a right side view of FIG. 10 (A), FIG. 11 (A) is a view seen along a F-F line of FIG. 10, FIG. 11 (B) is a view seen along a G-G line of FIG. 10, FIG. 12 is a schematic view of an assembly of the catheter kit of this example in the free state, FIG. 13 is an enlarged longitudinal cross-sectional view of FIG. 12, FIG. 14 is an enlarged schematic view of an assembly of the catheter kit of this example in the external force acting state, FIG. 15 is a view explaining the action of regulating tube deformation in the catheter kit of this example, and FIG. 16 is a view explaining deformation of a tube in the previous catheter kit.

In the catheter kit for a fistula in a second embodiment shown in FIG. 8 to FIG. 15, the same symbols are assigned to the same constitutional elements in FIG. 1 to FIG. 7, explanation thereof will be omitted, and different points will be mainly explained. That is, in the catheter kit in the second embodiment, different points from the catheter kit in the first embodiment are that a guidewire passage of an obturator is a groove part, that an external cylinder of an obturator is provided as a new constitutional member, and that a lock mechanism is provided on an obturator and an external cylinder.

A guidewire passage of an obturator 20*a* used in the catheter kit of this example is a groove part 22*a*. Since this obturator 20*a* uses an external cylinder 60 described later upon engagement with a catheter, a hollow part is formed by the groove part 22*a* and an internal wall of the external cylinder 60. For this reason, insertion and guidance of a guidewire 40 are not prevented. In addition, an obturator 20*a* equipped with a groove part 22*a* can reduce a cost of manufacturing by injection molding as compared with an obturator 20 equipped with a hollow part on a circular cross-section.

In addition, the obturator 20*a* has a projection 29 constituting a lock mechanism above the groove part 22*a* and below an operating part 21. The projection 29 is at a position which is traveled by 90 degree in a circumferential direction relative to a guidewire passage 22*a*, is formed at a tip of a thin plate 28 branching from a rod body 25, and is forced by a spring outwardly. The projection 29 determines a position of a tip of an obturator at arbitrary two positions relative to a position of a tip of an external cylinder, by engaging with two lock pores 62*a*, 62*b* provided on an external cylinder 60 described later. A position of the projection 29 is not limited to a position which is traveled by 90 degree in a circumferential direction relative to a guidewire passage 22*a*, but may be any position.

The external cylinder 60 is usually manufactured by injection molding, and has a regulating part 64 which is evulsibly engaged with a tube 11 of a catheter and regulates deformation of the tube 11 having an external diameter slightly smaller than an internal diameter of the tube 11, an obturator passage 61 with which an obturator 20*a* is slidably engaged, a transverse pore 63 for taking out a guidewire 40 outside therefrom, and lock pores 62*a*, 62*b* which are provided at two places of a prescribed interval under and above a position which is above the transverse pore 63 and is traveled by 90 degree in a circumferential direction relative to the transverse pore 63. The external cylinder 60 of this example uses a cylindrical object which is fitted into a tube 1 approximately without a gap, its circular external circumferential surface is a regulating part 64, and a hollow part of the cylindrical object is an obturator passage 61.

That is, the regulating part 64 is of an external circumferential surface shape on a tip side of the external cylinder 60, and is for regulating deformation of a tube 11 in a longitudinal direction when an external force is acted on an internal indwelling part 12. In the previous catheter kit shown in FIG. 16, a gap 112 is present between the tube 11 and the obturator 20*a*. For this reason, when an abutting part 18 of an internal indwelling part 12 is pushed and expanded with the obturator 20*a*, not only the internal indwelling part 12, but also the tube 11 are expanded while a diameter is reduced as shown by a two dot chain line of FIG. 16 and, as a result, a whole is extended, leading to a length of $l_3+l_4+l_5$. To the contrary, in the catheter kit 50*a* of this example, since a cylindrical external cylinder 60 is fitted into the tube 11 approximately without a gap, the external cylinder regulates reduction in a diameter of the tube 11 even when an external force acts thereon. For this reason, an acting force is hardly exerted on the tube 11, an acting force is concentrated only on an internal indwelling part 12, and deformation of the tube 11 in a longitudinal direction is regulated. In FIG. 15, a whole length is $l_3+l_5$. Like this, a shape of the regulating part 64 is not limited to such a shape that a force is acted on a whole internal circumferential surface of the tube 11 without a gap, but it is enough that a part thereof is abutted, and examples include a general I-letter cross section, a general T-letter cross section, a general reverse T-letter cross section, a general cruciform cross section, and a general rectangular cross section.

The obturator passage 61 is usually a circular hollow part, with which the obturator 20*a* is slidably engaged. An internal diameter of the obturator passage 61 is preferably slightly greater than an external diameter of the obturator 20*a* in that the obturator 20*a* can be slided without undergoing a frictional resistance in the obturator passage 61, and operation becomes easy.

The traverse pore 63 is arranged so that, at engagement of the external cylinder 60 and the catheter 10, it is situated above the catheter 10, and is overlaid with a groove part 22*a* of the obturator 20*a*. Thereby, an insertion pore of a guidewire 40 which is formed by a groove 22*a* of the obturator 20*a* and the transverse pore 63 is communicated with the outside. Therefore, the guidewire 40 is used by inserting into a communicating pore 15, a groove part 22*a* and a transverse pore 63 of the catheter 11 and, at the same time, can guide insertion of an assembly of the internal indwelling part 12, the tube 11, the obturator 20*a* and the external cylinder 60 into stomach from outside a body via a fistula 33, in its inserted state.

When two lock pores 62*a*, 62*b* are engaged with a projection 29 of an obturator 20*a*, a position of a tip of the obturator 20*a* can be determined at arbitrary two positions relative to a position 111 of a tip of an external cylinder 60. That is, in the free state shown in FIG. 13, the projection 29 of the obturator 20*a* and the lock pore 62*a* above an external cylinder 60 are engaged. Thereby, a position of a tip of the obturator 20*a* is at an abutting part 18 of an internal indwelling part 12 in the free state, relative to a position 111 of a tip of an external cylinder 60 which is a position connecting a tube 11 and an internal indwelling part 12. On the other hand, in the external force acting state shown in FIG. 14, the projection 29 of the obturator 20*a* and the lock pore 62*b* below an external cylinder 60 are engaged. Thereby, a position of a tip of the obturator 20*a* is isolated from a position 111 of a tip of an external cylinder 60, pushing and expanding an abutting part 18 of an internal indwelling part 12. In this lock function, since a catheter 10 is made of an elastically deformable material, a lock position can be easily switched by a reaction force of the internal indwelling part 12. Since by the lock function, it becomes possible to maintain the internal indwelling part 12 in the free state and the external force acting state, respectively, it is not necessary to perform operation of pushing and expanding the internal indwelling part 12 by the obturator 20*a*, and operation of inserting the catheter 10 into a body simultaneously, thereby, a working efficiency is improved. In addition, the lock function may be formed of a spring and a projection fitting with the spring, not a projection 29 of a plate spring of the obturator 20*a* as shown in FIG. 12 to FIG. 14. Since lock mechanism is attained by sliding the projection 29 only in a longitudinal direction without moving between lock pores 62*a*, 62*b* in a circumferential direction, there is no influence on guidance system of a transverse pore 63 and a guidewire 40.

A method of using the catheter kit for a fistula of the second embodiment is a method of using the catheter kit for a fistula for providing a stomach fistula for a living body, in which a step of inserting a guidewire which is formed so as to penetrate an abdominal wall and a stomach wall of a living body and is to be inserted into a fistula through a communicating pore, a groove part and a traverse pore in the state where locked in the free state or the external force acting state by lock mechanism, a step of inserting an assembly of a catheter, an obturator and an external cylinder into stomach from outside a body via the fistula while the assembly is guided by a guidewire in the external force acting state, to embed an internal indwelling part in stomach, and a step of eliminating locking, evulsing the obturator and the external cylinder from the catheter to elastically recovering the internal indwelling part to the free state, and evulsing the guidewire outside a body are performed in this order. A method of using the catheter kit for a fistula of this second embodiment will be explained mainly for different points from the first embodiment. That is, the second embodiment is different from the first embodiment in a pre-step of inserting a catheter kit 50*a* in stomach. That is, in the pre-step of inserting a catheter kit 50*a* in stomach, an external cylinder 60 and an obturator 20*a* are engaged with a catheter 10, to assemble them (FIG. 12 and FIG. 13). That is, an external cylinder 60 is fitted into a tube 11 of a catheter 10, and an obturator 20*a* is fitted into an obturator passage 61 of an external cylinder 60. Thereupon, an operating part 21 of the obturator 20*a* is slightly pushed to abut a tip 24 of the obturator 20*a* against an abutting part 18 of an internal indwelling part 12. At that time, a diameter of the internal indwelling part 12 is expanded outwardly in a radial direction of the tube 11, and is in the projected free state. Then, a communicating pore 15 of an internal indwelling part 12, a groove part 22*a* of the obturator 20*a*, and a traverse pore 63 of an external cylinder 60 are passed through in this order relative to a guidewire 40 which has exited from an insertion pore 33, and a catheter assembly is inserted toward stomach.

Then, when an operating part 21 is pushed in, the internal indwelling part 12 undergoes reduction in a diameter from the projected state by action of an external force with an obturator 20*a* and, at the same time, is deformed into the external force acting state (FIG. 14). In this state, a catheter assembly is locked, and a groove part 22*a* of an obturator 20*a* through which a guidewire 40 is inserted, and a communicating pore 15 provided on an abutting part 18 are become in the inserted state. In addition, a timing at which a guidewire 40 is inserted in a communicating pore 15 of an internal indwelling part 12, a groove part 22*a* and a traverse pore 63 is not limited to the aforementioned timing, but this may be performed after the internal indwelling part 12 is brought into the external force acting state.

In a step of inserting a catheter kit 50*a* in stomach, an assembly of a catheter 10 containing an elastically deformed internal indwelling part 12 having a diameter reduced than the projected state, an obturator 20*a* and an external cylinder 60 may be inserted in stomach along a guidewire 40 by the same method as that of the first embodiment. According to the assembly of the catheter 10, the obturator 20*a* and the external cylinder 60 of this example, since the internal indwelling part 12 can be maintained in the external force acting state by lock mechanism, it is not necessary to perform an operation of pushing an expanding the internal indwelling part 12 with the obturator 20*a*, and an operation of inserting the catheter 10 in a body simultaneously, thus, a working efficiency is improved.

After the internal indwelling part 12 is inserted into a body by the assembly of the catheter 10, the obturator 20*a* and the external cylinder 60, lock mechanism in the external force acting state is eliminated to recover the internal indwelling part 12 to the free state. Thereby, function of preventing the catheter 10 from being evulsed from a patient is also recovered. Thereafter, the guidewire 40, the obturator 20*a*, and the external cylinder 60 are evulsed from a patient. Thereby, embedment of the catheter 10 in a patient is completed.

According to the method of using the catheter kit for a fistula of the second embodiment, the same effect as that of the method of using the kit of the first embodiment is exerted, additionally, in the catheter kit 50*a*, since an external cylinder 60 is fitted in the tube 11 approximately without a gap, an acting force is hardly exerted on the tube 11 even when an external force is acted, and an acting force can be concentrated only on an internal indwelling part 12. For this reason, a smaller acting force is enough as compared with the case where an external cylinder 60 is not used, and a life of an abutting part 18 is prolonged. In addition, since in the obturator 20*a*, the guidewire 40 is passed through a passage formed of a groove part 22*a* and an external cylinder 60, the passage functions as a hollow part. In addition, since the internal indwelling part 12 is maintained in the external force acting state by lock mechanism, it is not necessary to perform an operation of pushing and expanding the internal indwelling part 12 of the catheter 10, and an operation of inserting the catheter 10 into a body simultaneously, thus, a working efficiency is improved.

Figure 17:
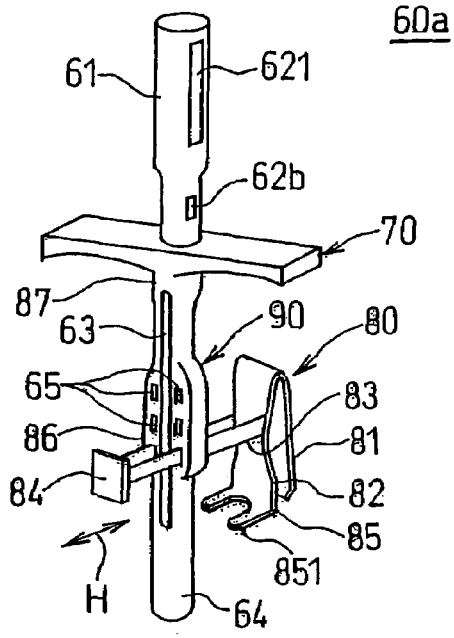
FIG. 17 is a perspective of an external cylinder used in a catheter kit of the third embodiment, FIG. 18 (A) is a front view of an external cylinder of FIG. 17, FIG. 18 (B) is a left side view of (A)
Figure 20:
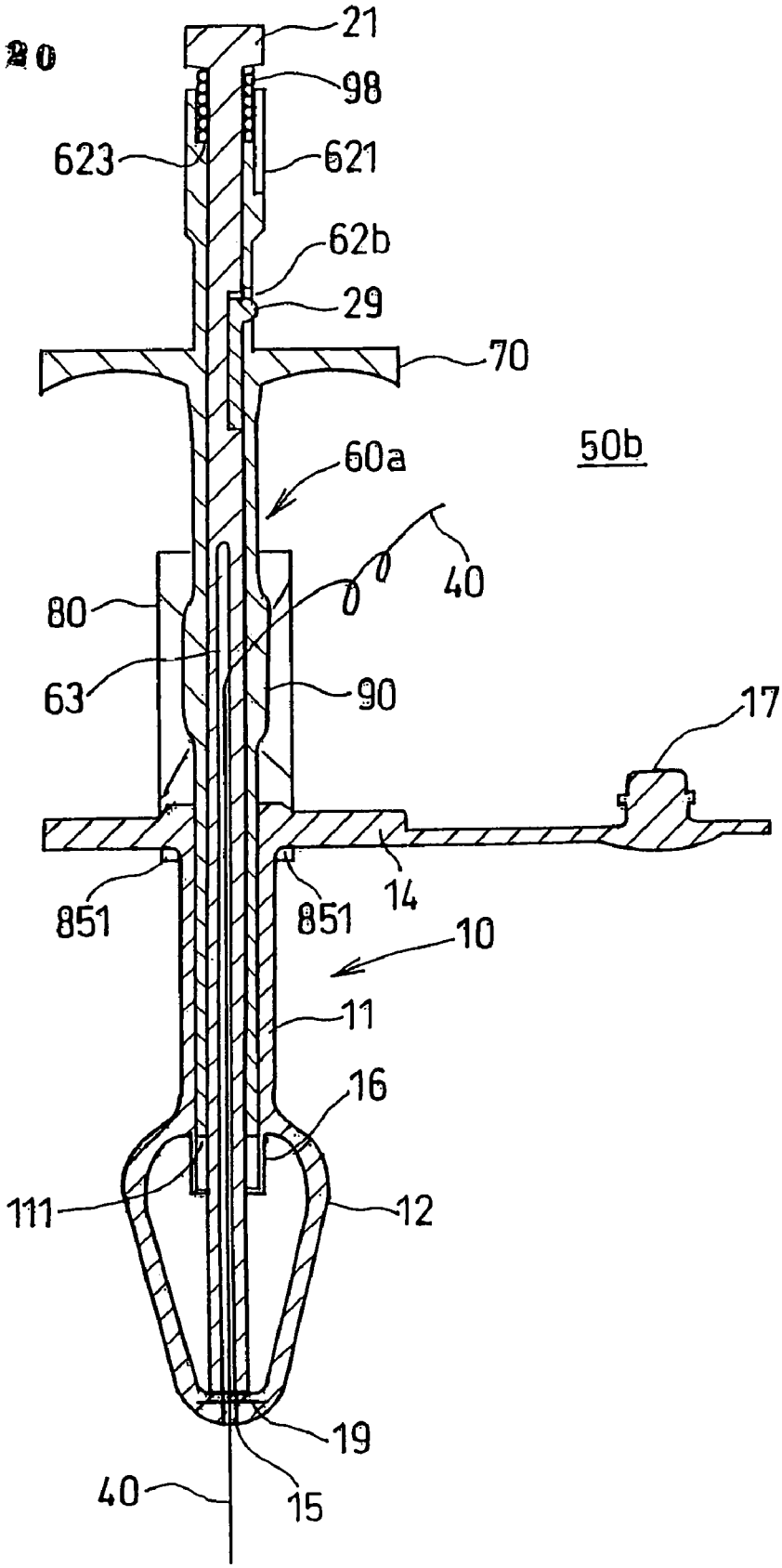
FIG. 20 is a longitudinal cross-sectional view of an assembly of the catheter kit of this example in the external force acting state.
Figure 21:
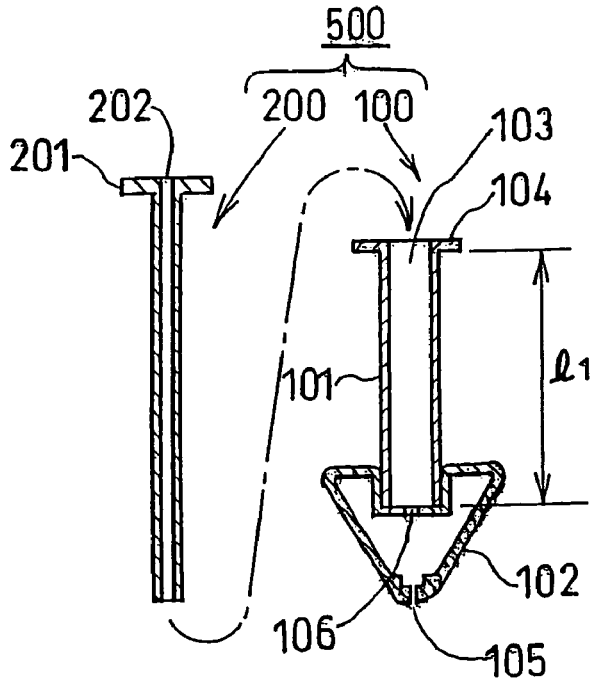
FIG. 21 is a schematic view of the previous catheter kit in the free state.
Figure 22:
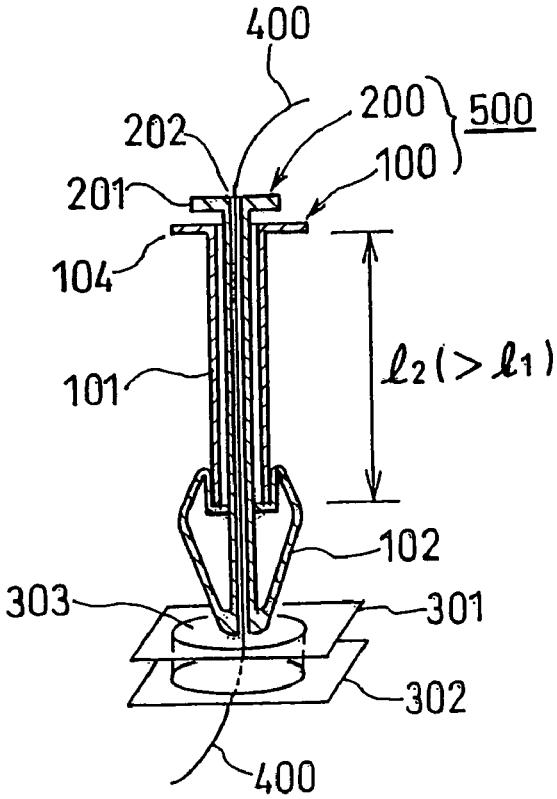
FIG. 22 is a schematic view of the previous catheter kit in the external force acting state.

Then, the catheter kit for a fistula in a third embodiment will be explained by referring to FIG. 17 to FIG. 20. FIG. 17 is a perspective of an external cylinder used in this example, FIG. 18 (A) is a front view of an external cylinder of FIG. 17, FIG. 18 (B) is a left side view of (A), FIG. 19 is a longitudinal cross-sectional view of an assembly of the catheter kit of this example in the free state, and FIG. 20 is a longitudinal cross-sectional view of an assembly of the catheter kit of this example in the external force acting state.

In the catheter kit for a fistula in the third embodiment shown in FIG. 17 to FIG. 20, same symbols are assigned to the same constitutional elements as those in FIG. 8 to FIG. 16, explanation thereof will be omitted, and different points will be mainly explained. That is, in the catheter kit in the third embodiment, main different points from the catheter kit of the second embodiment are that a finger hook and a stopper are provided on an external cylinder, and that a spring intervenes when an obturator is fitted with an external cylinder. That is, an external cylinder 60*a* of this example further has a first base end part 86 which is situated above a regulating part 64 and to which a stopper 80 is attached, and a finger hook 70 which is provided on a second base end part 87 situated above the first base end part 86, in the projected state in a direction orthogonal with a radial direction of an external cylinder. In addition, a traverse pore 63 is formed in an axial direction at approximately a length from the first base end part 86 to the finger hook 70, and an upper lock pore 621 is formed in an axial direction at a prescribed length in a cylinder member on an upper side of an external cylinder. In addition, a step 623 on which one end of a spring is fixed is formed in an obturator passage 61 of an external cylinder 60*a*.

The finger hook 70 provided on a second base end part 87 of an external cylinder 60*a* pushes in an operating part 21 of an obturator 20*a*, assists operation of transmitting an external force to an internal indwelling part 12 of a catheter 10, and facilitates operation by one hand of an operator. Therefore, when an obturator 20*a* is a force point, a finger hook 70 of an external cylinder 60*a* becomes a fulcrum, thereby, operability of transmitting an external force with an obturator 20*a* to an internal indwelling part 12 of a catheter 10 can be considerably improved.

A stopper 80 is a member for regulating movement of a catheter 10 in a tip direction relative to an external cylinder 60*a* when the internal indwelling part undergoes reduction in a diameter by action of an external force, and has an arm-like slide part 83 which is formed on a first base end part 86 and can be slid to a fitting part 65, a fixing part 85 which is provided on one end of the slide part 83 and is equipped with one pair of holding parts 851 spaced by approximately the same length as an external diameter of a tube 11, a spring-like first pushing in part 81 which extends from one end of the fixing part 85 in a direction bent by 180 degree, and a second pushing in part 84 which is provided on another end of the slide part 83. A shape of a fitting part 65 formed on the first base end part 86 is not particularly limited, but examples include a hole shape such as a round hole and a square hole; a groove shape such as a J-letter groove, a T-letter groove, and a curved groove. In this case, a cross section shape of the slide part 83 is appropriately determined depending on a shape of the fitting part 65. The fitting part 65 is preferably groove-shaped in that the slide part 83 of a stopper 80 can be detachably attached to the fitting part 65. In addition, it is preferable that a plurality of fitting parts 65 formed on the first base end part 86 are provided at an appropriate pitch relative to an axial direction. Thereby, by attaching the stopper 80 at an appropriate position of the fitting part 65 of an external cylinder 60*a*, and changing a position of a holding part 851, the kit can respond to various catheters 10 having different tube 11 lengths.

Figure 18:
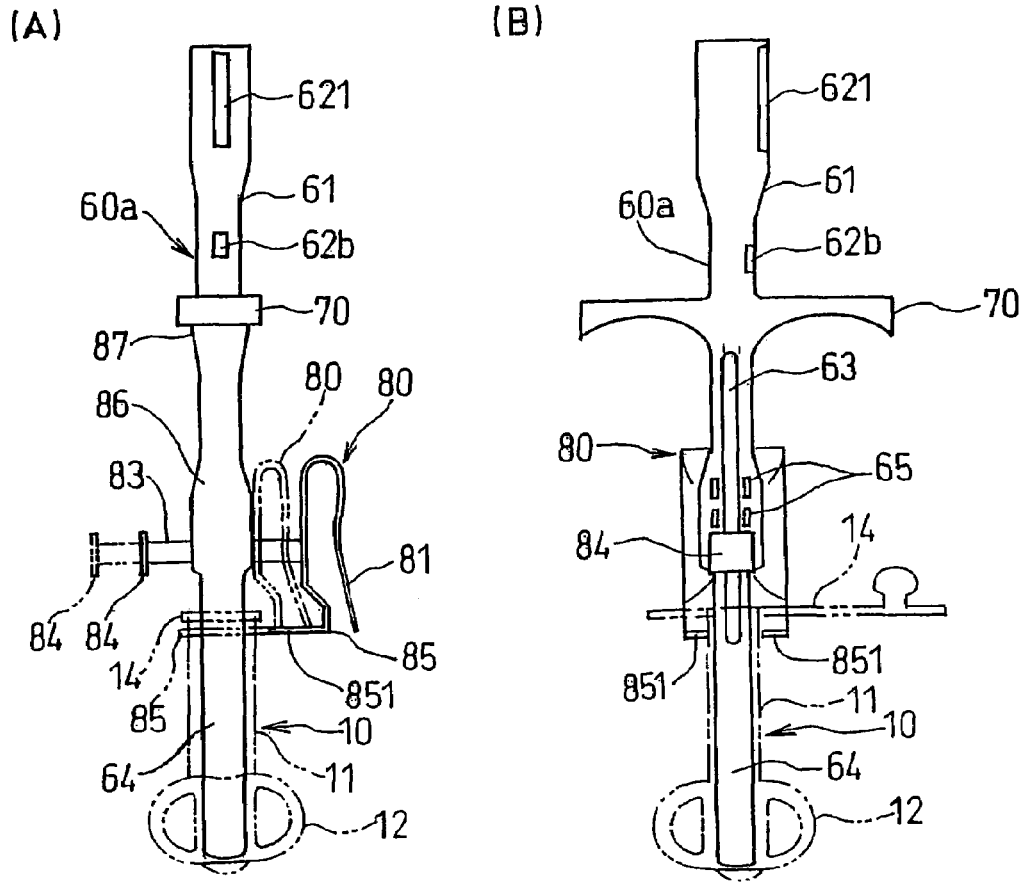
Figure 10:
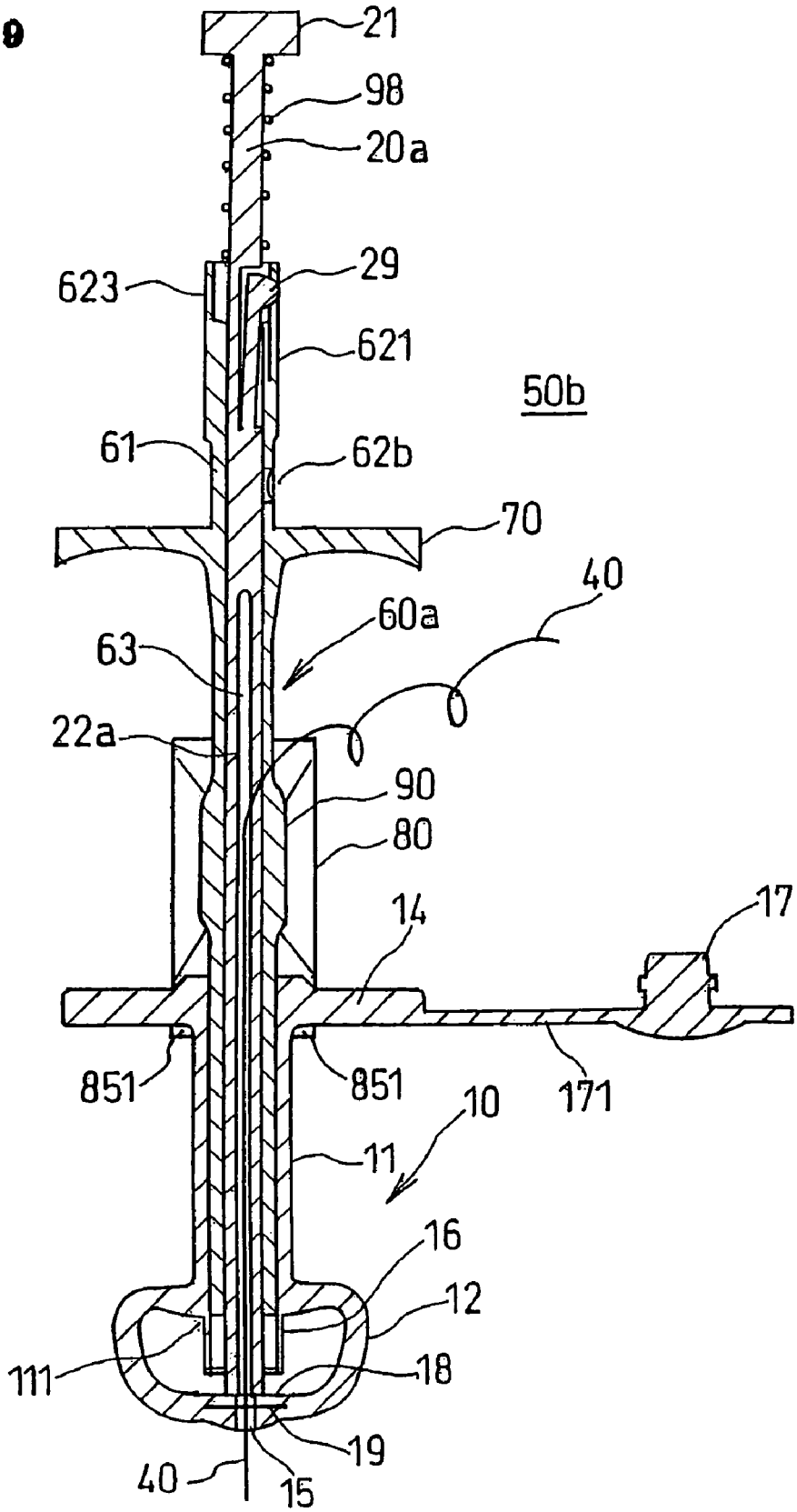

In order to assemble a catheter 10 and an external cylinder 60*a* using a stopper 80, after a position of a catheter 10 and that of an external cylinder 60*a* are determined to engage them in advance (a solid line of FIG. 18 (A)), a first pushing in part 81 is pushed into an external cylinder 60*a* side, and a catheter 10 is held so that a holding part 851 is situated beneath an extracorporeal fixing part 14 (a two dot chain line part of FIG. 18 (B)). Thereby, since slippage of a positional relationship of a catheter 10 and an external cylinder 60*a* accompanied with operation of pushing and expanding a catheter 10 can be eliminated and, at the same time, an acting force can be concentrated only on an internal indwelling part 12, thereby a tube 11 is not pushed and expanded meaninglessly.

Regarding a method of using the catheter kit for a fistula of the third embodiment, different points from the second embodiment will be mainly explained. That is, in the third embodiment, main different point from the second embodiment is a pre-step of inserting a catheter kit 50*b* in stomach. That is, in a pre-step of inserting a catheter kit 50*b* in stomach, an external cylinder 60*a* and an obturator 20*a* are engaged with a catheter 10 to assemble them. That is, an external cylinder 60*a* in the state where an obturator 20*a* is fitted in an obturator passage 61 is fitted in the tube 11 of a catheter 10, then, a first pushing in part 81 of a stopper 80 is pushed into an external cylinder 60*a* side, and a tube 11 beneath an extracorporeal fixing part 14 is held by a holding part 851 of a stopper 80 to obtain a catheter assembly. Thereupon, an operating part 21 of an obturator 20*a* is slightly pushed in to abut a tip 24 of an obturator 20*a* against an abutting part 18 of an internal indwelling part 12. Thereupon, a diameter of an internal indwelling part 12 is expanded outwardly in a radial direction of a tube 11, and the part is in the projected free state (FIG. 19). When an obturator 20*a* is fitted in an obturator passage 61, a spring 98 intervenes in advance. Then, a communicating pore 15 of an internal indwelling part 12, a groove part 22*a* of an obturator 20*a*, and a traverse pore 63 of an external cylinder 60*a* are passed in this order relative to a guidewire 40 which has exited outside a body through an insertion pore 33, and a catheter assemble is inserted towards stomach, respectively.

Then, for example, when a forefinger and a middle finger are hooked on a finger hook 70, a thumb is hooked on an operating part 21 of an obturator 20*a*, and an operating part 21 of an obturator 20*a* is pushed in using a finger hook 70 of an external cylinder 60*a* as a fulcrum, an internal indwelling part 12 undergoes reduction in a diameter from the projected state by action of an external force with an obturator 20*a* and, at the same time, is deformed into the external force acting state (FIG. 20). In this state, a catheter assembly is locked, a groove part 22*a* of an obturator 20*a* through which a guidewire 40 is inserted, and a communicating pore 15 provided on an abutting part 18 become into the inserted state.

After the internal indwelling part 12 is inserted into a body by an assembly of the catheter 10, the obturator 20*a* and the external cylinder 60*a*, a projection 29 is pushed in, a lock mechanism in the external force acting state is eliminated, and a second pushing in part 84 of a stopper 80 is pushed in an external cylinder 60*a* side, holding of the tube 11 is eliminated, and the internal indwelling part 12 is recovered to the free state. Thereby, function of preventing evulsion of the catheter 10 from the patient is also recovered. Thereafter, the guidewire 40, the obturator 20*a*, and the external cylinder 60*a* are evulsed. Thereby, embedment of the catheter 10 into a patient is completed.

Lock elimination of an assembly of the catheter 10, the obturator 20*a* and the external cylinder 60*a*, and elimination of holding action by the stopper 80 are not limited to the aforementioned order, and either elimination may be performed first, According to the method of using the catheter kit for a fistula of the third embodiment, the same effect as that of the method of using of the second embodiment is exerted, additionally, since in the catheter kit 50*b*, the external cylinder 60*a* is fitted in the tube 11 approximately without a gap, even when an external force is acted, an active force is hardly exerted on the tube 11, further, due to the action of the stopper 80, slippage of a positional relationship between the catheter 11 and the external cylinder 60*a* accompanied with pushing and expanding operation of the catheter 11 is abolished, and the active force can be further concentrated only on the internal indwelling part 12.

Alternatively, the catheter kit for a fistula of the present invention can be used when a catheter which has been already provided in a patient (catheter indwelling use) is exchanged with a new catheter. One example of this exchanging work is shown as follows. First, an obturator 20, or an obturator 20*a* and an external cylinder 60 (60*a*) is inserted into a catheter 10 which has been already provided in a patient, through an opening of a rear end of a tube 11. Then, a guidewire 40 is passed through an opening window 26 of an obturator 20, a guidewire passage 22 and a communicating pore 15 of an internal indwelling part 12 in this order, or through a traverse pore 63 of an external cylinder 60 (60*a*), a groove part 22*a* of an obturator 20*a* and a communicating pore 15 of an internal indwelling part 12 in this order, thereby, the guidewire 40 is inserted into stomach from outside a body. Then, the obturator 20 or an operating part 21 of the obturator 20*a* is pushed in to deform the internal indwelling part 12 into the external force acting state. And, while retained in this state, the catheter 10 is evulsed from a patient. Thereupon, only the catheter 10 and the obturator 20, or only the obturator 20*a* and the external cylinder 60 (60*a*) are evulsed from a patient, and the guidewire 40 is indwelled in the state where it is inserted in an abdominal wall 31 and a stomach wall 32. Thereby, evulsion operation of the catheter 10 during use is completed. Subsequently, by using a new catheter 10, and performing successfully a pre-step of inserting a catheter kit in stomach, and a step of inserting a catheter kit in stomach of the aforementioned first to third embodiment, work of exchanging a catheter is completed.

INDUSTRIAL APPLICABILITY

According to the present invention, since the guidewire passage and the operating part in the obturator are arranged in the isolated state, when a center of the operating part of the obturator is pushed with a finger, a force is effectively transmitted to the internal indwelling part of the catheter. In addition, an assemble of the catheter and the obturator, or an assembly of the catheter, the obturator and the external cylinder can be assuredly inserted in stomach from outside a body via a fistula by guidance of the guidewire. In addition, according to the present invention, in percutaneous endoscopic gastrostomy, only the internal indwelling part of the catheter can be pushed and expanded, operability is enhanced and, at the same time, it is not necessary to mind the guidewire, and alleviation of a stress of an operator, and shortening of an operation time can be expected.

The invention claimed is:

1. A catheter kit for a fistula, comprising:

a catheter which percutaneously replenishes a nutrient or a drug solution into stomach of a patient from outside a body of the patient;

an obturator; and an external cylinder, wherein the catheter has a tube extending along a wall surface of a fistula and in an interior thereof a nutrient passage for introducing a nutrient or a drug solution into the stomach from outside a body, a non-balloon-type internal indwelling part which is provided at a tip part of the tube, is in the projected state where a diameter of the internal indwelling part is expanded outwardly in a radial direction of the tube, in which a diameter thereof is reduced from the projected state by action of an external force with an obturator, and which is indwelled in the stomach in the state of embedment in the body, an extracorporeal fixing part which is provided at a rear end of the tube and is projected in a radial direction of the tube, and a communicating pore which is provided at a tip part of the internal indwelling part and is for making a guidewire passage of the obturator communicate with an interior of the stomach from outside the body, the obturator is evulsibly engaged with the catheter until it abuts against the internal indwelling part, and has the guidewire passage which is provided from a tip thereof to midway and through which a guidewire is passed, and an operating part which is provided at a rear end thereof and transmits the external force to the internal indwelling part, and a rear end part of the guidewire passage and the operating part are arranged in the isolated state, and the external cylinder is evulsibly engaged with the tube of the catheter and has an external circumferential surface shape on a tip side, the external circumferential surface shape has an external diameter smaller than an internal diameter of the tube such that the external diameter of the external circumferential surface shape is fitted to the internal diameter of the tube substantially without a gap along an entire length of the tube and regulates deformation of the tube in a longitudinal direction of the tube, and the external cylinder has an obturator passage with the obturator is slidably engaged.

2. The catheter kit for a fistula according to claim 1, wherein the obturator is evulsibly engaged with a tube of the catheter, and has an external diameter slightly smaller than an internal diameter of the tube.

3. The catheter kit for a fistula according to claim 1 or 2, wherein the guidewire passage which is provided from a tip of the obturator to midway is a hollow part or a groove part.

4. The catheter kit for a fistula according to claim 1, further comprising a guidewire which is used by inserting through the communicating pore and the guidewire passage and, in an inserted state, induces insertion of an assembly of the internal indwelling part, the tube and the obturator into stomach from outside a body via the fistula.

5. The catheter kit for a fistula according to claim 1, wherein the internal indwelling part is constructed as a malecot shape with a plurality of arms, and is provided with a notch inside a seam part between the arms on at least one of a tip side of the internal indwelling part and on a rear end side of the internal indwelling part.

6. The catheter kit for a fistula according claim 1, wherein an expanded diameter length (diameter) of the internal indwelling part in the free state is greater than a length in an axial direction of the tube, thereby, the internal indwelling part is flat-shaped.

7. The catheter kit for a fistula according to claim 1, wherein a projection is further provided at a tip of the internal indwelling part.

8. The catheter kit for a fistula according claim 1, wherein a tip part of the tube is further provided with a one-way valve for preventing a counterflow from the interior of the stomach to outside of the body via the nutrient passage.

9. The catheter kit for a fistula according claim 1, wherein a tip of the obturator of the internal indwelling part has an abutting part reinforced with a reinforcing member.

10. The catheter kit for a fistula according claim 9, wherein the reinforcing member is a mesh made of a metal.

11. The catheter kit for a fistula according to claim 1, further comprising a lock mechanism which includes a projection provided on the obturator and a plurality of lock pores provided on the external cylinder, wherein the lock mechanism determines a position of a tip of the obturator relative to a position of a tip of the external cylinder by fitting the projection and one of the lock pores.

12. The catheter kit for a fistula according to claim 1, wherein a stopper for regulating movement of the catheter relative to the external cylinder when the diameter of the internal indwelling part is reduced by the action of the external force is further provided on a base end part of the external cylinder.

13. The catheter kit for a fistula according to claim 12, wherein a finger hook which is projected outwardly in an axial direction of the external cylinder is further provided above the stopper and at a base end part of the external cylinder.

14. A catheter kit for a fistula, comprising:

a catheter which percutaneously replenishes a nutrient or a drug solution into stomach of a patient from outside a body of the patient, the catheter comprising a tube and an internal indwelling part, the tube configured to extend along a wall surface of a fistula and having a nutrient passage for introducing the nutrient or drug solution into the stomach from outside the body, he internal indwelling part being provided at a tip part of the tube, configured to project such that a diameter of the internal indwelling part is expanded outwardly in a radial direction of the tube and reduce the diameter by an external force applied with the obturator, and configured to be indwelled in the stomach;

an obturator configured to evulsibly engage with the catheter until the obturator abuts against the internal indwelling part; and an external cylinder configured to evulsibly engage with the tube of the catheter and having an external circumferential surface shape on a tip side and an obturator passage, the external circumferential surface shape having an external diameter smaller than an internal diameter of the tube such that the external diameter of the external circumferential surface shape is fitted to the internal diameter of the tube substantially without a gap along an entire length of the tube and regulates deformation of the tube in a longitudinal direction of the tube, the obturator passage configured to slidably engage with the obturator.

* * * * *